US009067212B2

(12) United States Patent
Kato

(10) Patent No.: US 9,067,212 B2
(45) Date of Patent: Jun. 30, 2015

(54) MILL

(71) Applicant: TSUKASA CO., LTD., Handa-shi, Aichi-ken (JP)

(72) Inventor: Fumio Kato, Handa (JP)

(73) Assignee: TSUKASA CO., LTD., Handa-Shi, Aichi-Ken (JP)

( * ) Notice: Subject to any disclaimer, the term of this patent is extended or adjusted under 35 U.S.C. 154(b) by 116 days.

(21) Appl. No.: 13/791,959

(22) Filed: Mar. 9, 2013

(65) Prior Publication Data

US 2013/0186990 A1 Jul. 25, 2013

Related U.S. Application Data

(63) Continuation-in-part of application No. PCT/JP2011/007059, filed on Dec. 18, 2011.

(51) Int. Cl.

| | |
|---|---|
| ***B02C 13/00*** | (2006.01) |
| ***B02C 19/06*** | (2006.01) |
| ***B02C 23/18*** | (2006.01) |
| ***B02C 13/18*** | (2006.01) |
| ***B02C 13/14*** | (2006.01) |
| *B02C 13/288* | (2006.01) |

(52) U.S. Cl.

CPC ..... *B02C 19/061* (2013.01); *B02C 23/18* (2013.01); *B02C 13/288* (2013.01); *B02C 13/1814* (2013.01); *B02C 13/18* (2013.01); *B02C 13/14* (2013.01)

(58) Field of Classification Search

CPC .. B02C 13/1814; B02C 13/18; B02C 13/288; B02C 23/18

USPC ..... 241/57, 62, 275

See application file for complete search history.

(56) References Cited

U.S. PATENT DOCUMENTS

| | | | | |
|---|---|---|---|---|
| 3,285,523 | A | 11/1966 | Duyckinck et al. | |
| 4,556,175 | A * | 12/1985 | Motoyama et al. | 241/57 |
| 4,623,098 | A * | 11/1986 | Motoyama et al. | 241/46.04 |
| 5,507,871 | A * | 4/1996 | Morino et al. | 118/680 |
| 5,904,951 | A * | 5/1999 | Yamanaka et al. | 427/2.14 |
| 6,629,653 | B2 | 10/2003 | Fahrbach et al. | |
| 6,745,960 | B1 * | 6/2004 | Myo et al. | 241/5 |
| 7,753,298 | B2 * | 7/2010 | Basten | 241/62 |
| 8,807,070 | B2 * | 8/2014 | Jensen | 118/303 |

FOREIGN PATENT DOCUMENTS

| | | |
|---|---|---|
| JP | 15-16420 | 2/1940 |
| JP | 50-21695 | 7/1975 |
| JP | 57-190656 A | 11/1982 |

(Continued)

*Primary Examiner* — Faye Francis

(74) *Attorney, Agent, or Firm* — Matthias Scholl, PC; Matthias Scholl

(57) ABSTRACT

A mill includes a grinding chamber, a rotating shaft located in the grinding chamber, a rotating body structured to have a rotary member fixed to the rotating shaft, a casing provided to form an outer shell of the grinding chamber, an inlet arranged to supply a solid-gas two-phase flow K containing particles and a gas to the grinding chamber, and an outlet arranged to discharge the solid-gas two-phase flow K' from the grinding chamber. A cylindrical frame member having an inner peripheral surface formed in a corrugated shape is located in the casing. The solid-gas two-phase flow K supplied via the inlet into the grinding chamber is circled in the grinding chamber, while being accelerated by the rotating body.

7 Claims, 10 Drawing Sheets

(56) References Cited

FOREIGN PATENT DOCUMENTS

| | | | |
|---|---|---|---|
| JP | 59-73065 | A | 4/1984 |
| JP | 3-208851 | A | 9/1991 |
| JP | 7-33998 | U | 6/1995 |
| JP | 7-213940 | A | 8/1995 |
| JP | 9-24285 | A | 1/1997 |
| JP | 9-193133 | A | 7/1997 |
| JP | 2001-507636 | A | 6/2001 |
| JP | 2002-59024 | A | 2/2002 |
| JP | 2003-88773 | A | 3/2003 |
| JP | 2005-66508 | A | 3/2005 |
| JP | 2005-66511 | A | 3/2005 |
| JP | 2005-169246 | A | 6/2005 |
| JP | 2010-201289 | A | 9/2010 |
| JP | 2011-152518 | A | 8/2011 |
| JP | 2012-115734 | A | 6/2012 |

* cited by examiner

MILL

CROSS-REFERENCE TO RELATED APPLICATIONS

This application is a continuation-in-part of International Patent Application No. PCT/JP2011/007059 with an international filing date of Dec. 18, 2011, designating the United States, now pending. The contents of the aforementioned application, including any intervening amendments thereto, are incorporated herein by reference. Inquiries from the public to applicants or assignees concerning this document should be directed to: Matthias Scholl P. C., Attn.: Dr. Matthias Scholl Esq., 14781 Memorial Drive, Suite 1319, Houston, Tex. 77079.

BACKGROUND OF THE INVENTION

1. Field of the Invention

The present invention relates to a mill configured to grind or pulverize particles of, for example, foods, chemicals and pharmaceutical products.

2. Description of the Related Art

One proposed structure of a conventional jet mill (impact-type airflow grinder) to grind the material accelerates a grinding object in a grinding chamber by the air jet flow from a nozzle and makes the grinding object collide against a collision plate (PTL1). Another proposed structure makes the particles of the grinding object collide with one another by the air jet flow (PTL2). The jet mill is characteristic of finely grinding or pulverizing the particles with limited temperature increase during the grinding action.

CITATION LIST

Patent Literature

PTL1: JP 2002-59024a
PTL2: JP 2003-88773A

SUMMARY OF THE INVENTION

Technical Problem

The conventional jet mill, however, has the problem of the relatively low throughput per energy cost. The object of the invention is accordingly to provide a mill having the increased throughput per energy cost.

Solution to Problem

In order to solve at least part of the above problem, according to a first aspect of the invention, there is provided a mill, comprising: a grinding chamber; a rotating shaft located in the grinding chamber; a rotating body structured to have a disk-shaped rotary member fixed to the rotating shaft; and a casing provided to form an outer shell of the grinding chamber. A cylindrical frame member having an inner peripheral surface formed in a corrugated shape along a circumferential direction is arranged coaxially with the rotating shaft in the casing, wherein the corrugated shape has a pitch that is greater than an amplitude. The rotary member has a circular member. A solid-gas two-phase flow of particles and a gas supplied to the grinding chamber is introduced through a gap between the casing and the rotating body into the grinding chamber, is circled in the grinding chamber while being accelerated by the rotating body, and collides against the inner peripheral surface and the circular member to grind or pulverize the particles.

According to one preferable embodiment, the mill further includes a preliminary grinder located at an inlet of the gap and structured to have a shock pin.

The circular member is preferably a ring-shaped member but may be an arc-shaped member. According to another preferable embodiment, the circular member includes a plurality of support plates arranged circularly and protruded in a radial direction, and circular plates linked by the support plates, wherein the solid-gas two-phase flow is circled by rotation force of the circular plates and is collided against the inner peripheral surface in the circumferential direction.

According to another preferable embodiment, the mill further includes a preliminary grinder located at an inlet of the casing and structured to have a shock pin.

The inner peripheral surface is preferably formed to have regular waveform but may include a surface of irregular shape according to the requirements. It is preferable that the entire inner peripheral surface or part of the entire inner peripheral surface is formed in the corrugated shape. It is also preferable that the pitch of the waveform is set to be greater than the amplitude.

This mill is applicable to both an inline particle air-conveying system and a non-inline particle air-conveying system. According to one preferable embodiment of the inline system, the mill is placed in the middle of or at the end of a pneumatic conveying line for the mixture of the particles and the air, and the ground or pulverized material is conveyed pneumatically.

According to one preferable embodiment, the circular member is provided as a blade and includes support plates and circular plates linked by the support plates. The solid-gas two-phase flow is collided against the inner peripheral surface in the circumferential direction, while being circled by the rotation force of the circular plates.

Advantageous Effects of Invention

The mill according to the first aspect of the invention reduces the particle size and enhances the grinding effect by diffused reflection of the circled particles by the frame member of the corrugated shape. The mill of this aspect also enhances the throughput per energy cost. The mill of this aspect does not require an air jet nozzle or a collision plate, which are included in the conventional structure, and can thus be downsized.

The mill according to the second aspect of the invention performs preliminary grinding, so as to enhance the grinding effect in the grinding chamber.

The mill according to the third aspect of the invention enhances the circling effect of the solid-gas two-phase flow.

DETAILED DESCRIPTION OF THE EMBODIMENTS

Figure 1:
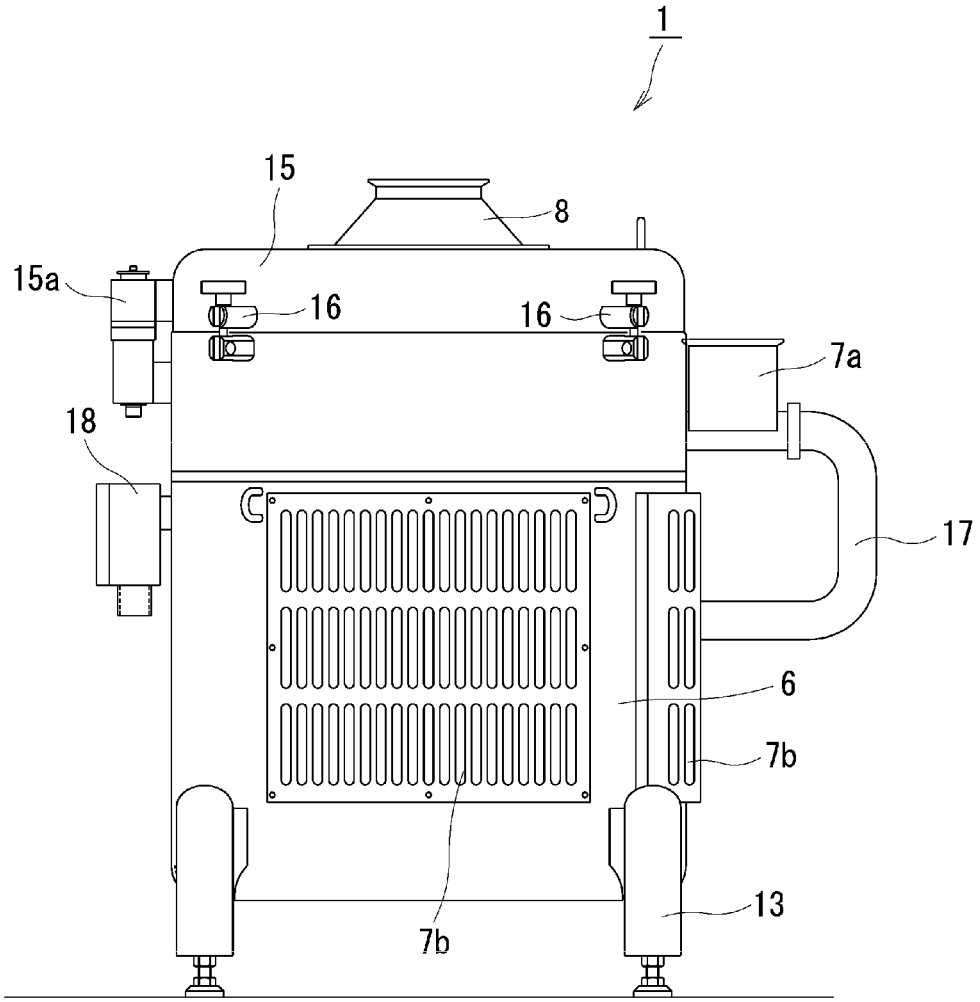
FIG. 1 is a front view illustrating a mill according to a first embodiment of the invention.

As shown in FIGS. 1 to 4, a mill 1 according to a first embodiment of the invention includes a grinding chamber 2, a rotating shaft 3 located in the grinding chamber 2, a rotating body 5 structured to have a rotary member 4 fixed to the rotating shaft 3, a casing 6 provided to form an outer shell of the grinding chamber 2, an inlet 7*a* arranged to introduce particles PW into the casing 6, inlets 7*b* arranged to introduce a gas A into the casing 6, an inlet 7*c* arranged to supply a solid-gas two-phase flow K containing the particles PW and the gas A into the grinding chamber 2, and an outlet 8 arranged to discharge a solid-gas two-phase flow K' from the grinding chamber 2. A cylindrical frame member 9 having a corrugated inner peripheral surface 9*a* is arranged coaxially with the rotating shaft 3 in the casing 6. The solid-gas two-phase flow K supplied via the inlet 7*c* into the grinding chamber 2 is circled in the grinding chamber 2, while being accelerated by the rotating body 5. The circling solid-gas two-phase flow K collides against the inner peripheral surface 9*a*, so that the particles are ground or pulverized. The following describes the respective components more specifically with reference to the drawings.

Figure 3:
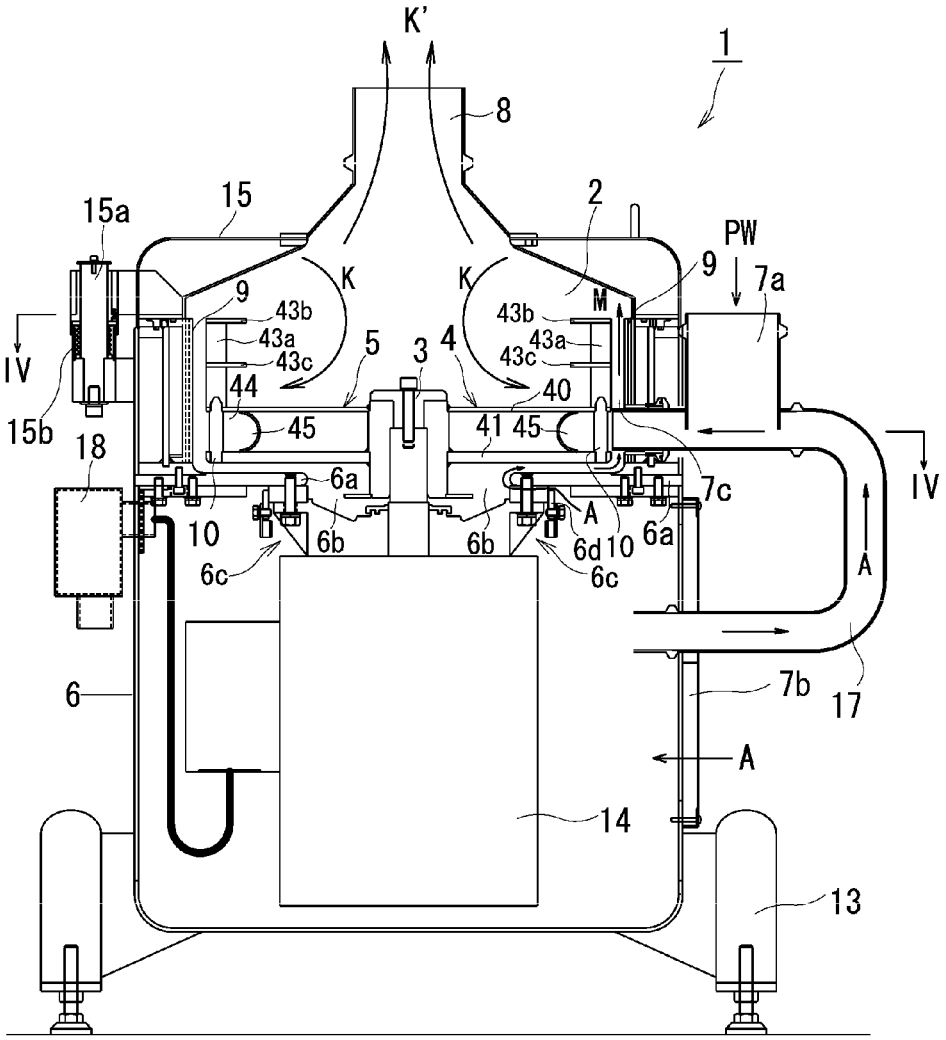
FIG. 3 is a cross sectional front view illustrating inside of the mill.
Figure 4:
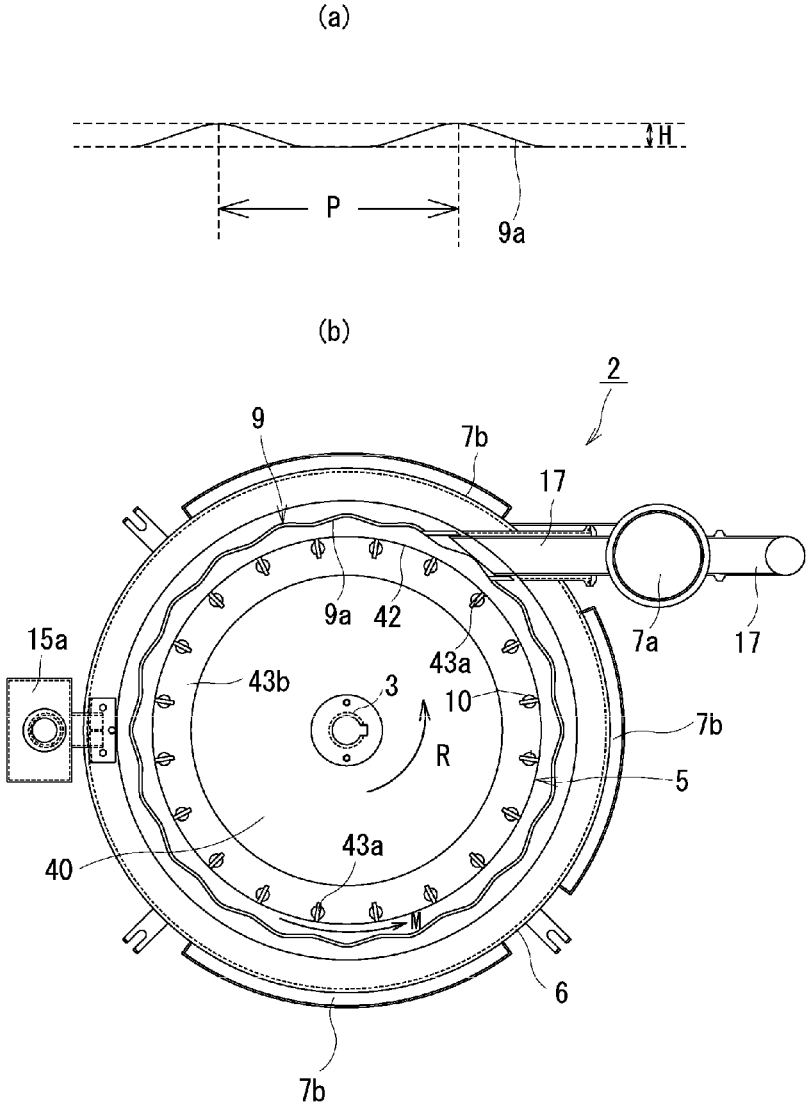
FIG. 4 is a cross sectional plan view taken on a line IV-IV in FIG. 3.

As shown in FIGS. 3 and 4, the grinding chamber 2 communicates with the inlet 7*c* on the upstream side, while communicating with the outlet 8 on the downstream side.

The rotating shaft 3 is arranged vertically. The rotating speed of the rotating shaft 3 may be, for example, 3000 to 7000 rpm.

As shown in FIGS. 3 and 4, the rotary member 4 is provided as a blade-like structure fixed on a disk and more specifically includes a downstream circular disc 40 that is arranged perpendicular to the rotating shaft 3 and is linked on the downstream side, an upstream circular disc 41 that is arranged perpendicular to the rotating shaft 3 and is linked on the upstream side, linkage pins 10 arranged parallel to the rotating shaft 3 to link the downstream circular disc 40 with the upstream circular disc 41, a plurality of support plates 43*a* protruded upward from the upstream circular disc 41 and arranged circularly to be protruded in the radial direction, circular plates 43*b* and 43*c* fixed in the horizontal orientation by the support plates 43*a*, and an interior space 44 defined by the downstream circular disc 40, the upstream circular disc 41, the linkage pins 10 and a partition plate 45. The interior space 44 is provided as an outside area of the partition plate 45. The circular plates 43*b* and 43*c* are arranged in two steps in the illustrated example of FIG. 3. This is, however, not restrictive and the circular plates may be arranged in any number of steps. The linkage pins 10 may be protruded downstream from the downstream circular disc 40. The circular, gutter-shaped partition plate 45 having the U-shaped vertical cross section is arranged to link the lower surface of the downstream circular disc 40 with the upper surface of the upstream circular disc 41 in an area inward of the outer peripheral edge. This partition plate 45 accordingly serves to prevent the particles and the gas from entering a hollow inner space of the rotary member 4 and also has the reinforcing function. The interior space 44 communicates with the grinding chamber 2 and forms part of the grinding chamber 2. The components located below the rotary member 4 serve to introduce the air into the grinding chamber 2. The circular plates 43*b* and 43*c* may be replaced with arc-shaped members.

The rotating body 5 includes the rotating shaft 3 and the rotary member 4. The mill 1 receives the air A and the particles PW and joins the received air A with the received particles PW to the solid-gas two-phase flow K. While the linkage pins 10 serve to grind or pulverize the particles, the rotating body 5 circles the solid-gas two-phase flow K, so that the particles collide against the inner peripheral surface 9*a* of the frame member 9 to be ground or pulverized. The solid-gas two-phase flow K' containing the ground or pulverized particles is then discharged. The linkage pins 10 are preferably formed to have a round lateral cross section, for example, a circular lateral cross section.

The suction pressure of a suction blower (not shown) and the rotating body 5 rotating at high speed generate the sucking flows via the inlets 7*a* and 7*b* into the grinding chamber 2. The solid-gas two-phase flow K containing the particles PW and the air A is accordingly supplied via the inlet 7*c* into the grinding chamber 2.

As shown in FIG. 3, an annular member 6*a* protruded circularly below the upstream circular disc 41 is provided as the structure to introduce the air into the grinding chamber 2. This annular member 6*a* is arranged parallel to the upstream circular disc 41 and has a plate member on its center. The annular member 6*a* is fixed to support members 6*c*, which are linked by the plate member. The support members 6*c* work to support a motor 14. The support members 6*c* are arranged at predetermined intervals or adequate intervals along the circumferential direction, and the respective intervals form passage 6*b*. The support member 6*c* is linked with a circular plate member 6*d*, which has a damper formed by, for example, a screw, to vertically adjust the height. The flow rate of the air flowing into the passage 6*b* is adjustable by regulating the gap from the lower surface of the annular member 6*a*. More specifically, the circular plate member 6*d* serves as the flow rate regulation damper (ring plate) to regulate the amount of the air sucked through the passage and the amount of the air sucked through a piping 17.

The inlet 7*a* serves as an inlet port of the particles PW. The inlets 7*b* are arranged at a plurality of different positions to serve as inlet openings of the air A and are provided with filters. The mill 1 according to the embodiment has the characteristic rotary member 4 and thereby does not require an air jet nozzle or a collision plate, which are included in the conventional structure.

A suction blower (not shown) is connected with the outlet 8 to suck the air and thereby allow the particles PW and the air A to be supplied via the inlets 7*a* and 7*b*.

As shown in FIGS. 3 and 4, the frame member 9 having the curved inner peripheral surface 9*a*, which is the characteristic structure of the embodiment, is fixed to the inner wall of the casing 6 to be arranged coaxially with the rotating shaft 3 and is located adjacent to the inner peripheral surface of the casing 6 across a gap. The inner peripheral surface 9*a* is a corrugated curved surface and has end faces at respective ends in the axial direction. The corrugated curved surface is formed as an endless curved surface in the circumferential direction to form the waveform of periodical change along the circumferential direction. The solid-gas two-phase flow K is accordingly compressed and expanded along the circumferential direction. The particles may collide against the frame member 9 or the rotary member 4 or may collide with one another. The amplitude of the wave along the circumference is preferably limited to a fixed value, and the pitch (cycle) is preferably a fixed value. The average wave height preferably forms a cylindrical shape. The number of wave crests or the number of wave troughs formed is twenty according to this embodiment. The number of wave crests or the number of wave troughs may, however, be set to an arbitrary value according to the design conditions. The pitch is set to be greater than the amplitude.

The pitch P (interval between the wave crests or the interval between the wave troughs) is preferably 50 to 200 mm, and the amplitude H (difference between the maximum diameter and the minimum diameter in the radial direction) is preferably 5 to 20 mm. The ratio of the pitch P to the amplitude H is preferably 2.5 to 40, more preferably 5 to 30 or most preferably 6 to 15. The height of the inner peripheral surface 9*a* of the frame member (length in the axial direction) depends on the number of steps of the circular plates 43*b* and 43*c*. The circular plates 43*b* and 43*c* are arranged in two steps in the illustrated example of FIG. 3 but may be arranged in only one step or in three or more steps. For example, in the two-step arrangement shown in FIG. 3, the height of the inner peripheral surface 9*a* is preferably 70 to 300 mm. This numerical range is not restrictive but may be changed according to the design conditions, for example, the diameter of the grinding chamber 2 and the type of the particles. The frame member 9 is subject to sheet metal processing. This reduces the cost, compared with machining As shown in FIG. 4, the frame member 9 is circularly arranged about the rotating shaft 3 to be coaxial with the rotating shaft 3. The material of the frame member 9 is preferably metal material but may be another material, such as ceramic material or hard plastic material. The frame member 9 is formed with no holes and is provided as an impermeable structure that does not allow permeation of the gas and the solid, for example, the particles. According to this embodiment, the frame member 9 is formed in the periodical waveform having the wave troughs and the wave crests arranged alternately in the circumferential direction. Alternatively the frame member 9 may be formed in an irregular waveform.

The throughput of the general jet mill using the power of 37 kW (compressor) is approximately 10 to 50 kg/hr with respect to the flour having the particle diameter of 10 μm. The mill 1 according to the embodiment using the power of 40 kW, on the other hand, has the throughput of 100 to 200 kg/hr with respect to the flour having the particle diameter of or below 50 μm. Since the application and the value of the product (ground or pulverized particles) depend on the particle size, the simple comparison is not easy. This, however, proves the increase of the throughput per the energy cost anyway.

As shown in FIG. 1, the mill 1 has a mount 13, on which the casing 6 is fixed.

As shown in FIGS. 1 and 3, the rotating shaft 3 is rotated and driven by the motor 14 fastened in the casing 6.

Figure 2:
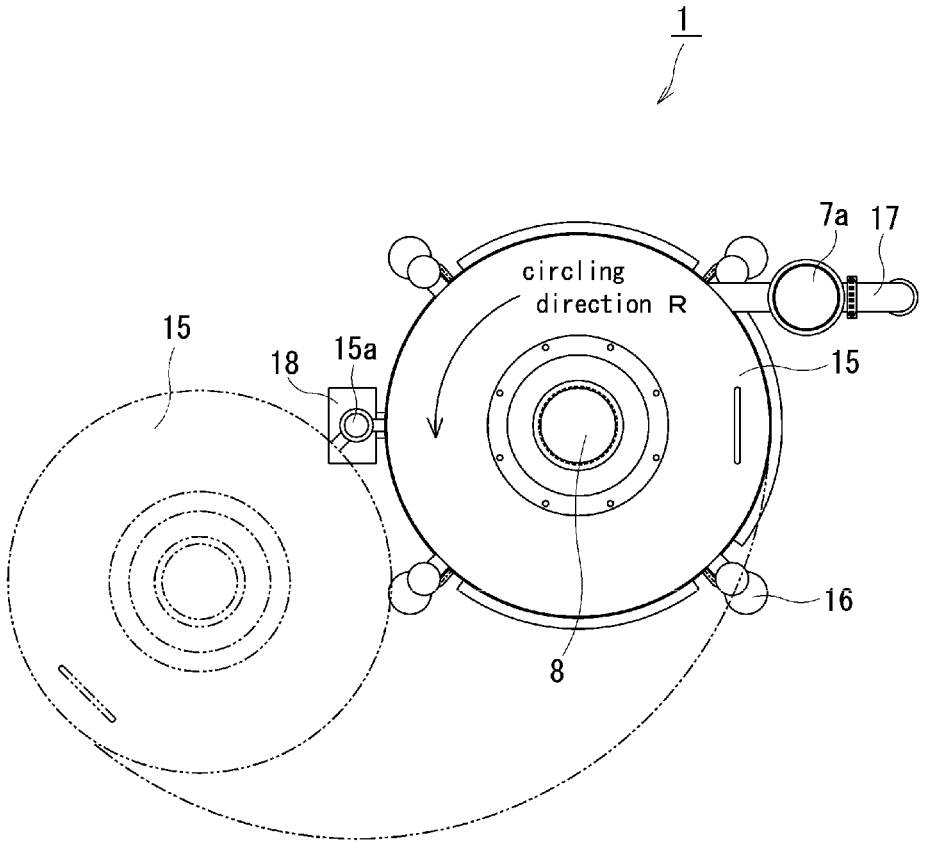
FIG. 2 is a plan view of the mill.

As shown in FIGS. 1 and 2, a door 15 and a hinge 15*a* for pivotally rotating the door 15 are provided on the upper portion of the casing 6 and are locked to the casing 6 by a locking device 16. A spring 15*b* is placed in the hinge 15*a* to produce the pressing force upward in view of the safety.

The piping 17 is arranged to transport upward the air A intake from the inlets 7*b*. The piping 17 is provided with the inlet 7*a* of the particles. The particles PW are mixed with the air A transported through the piping 17 to form the solid-gas two-phase flow K.

A power distribution unit 18 is connected with the motor 14.

The following describes the operations of the mill 1. During use of the mill 1, the door 15 is closed by the locking device 16. The door 15 is used for maintenance of, for example, the grinding chamber 2, the rotating shaft 3, the rotary member 4 and the rotating body 5.

The suction force is generated at the outlet 8 by the function of the blower (not shown), and the rotating body 5 is integrally rotated by the motor 14. The particles PW as the object material to be ground or pulverized are supplied from the inlet 7*a*, while the gas A is supplied through the inlets 7*b*. The gas A supplied through the inlets 7*b* passes through the filter, which prevents dust or foreign matter from entering the casing 6 and allows only the clean air to enter the casing 6. Part of the gas A passes through the piping 17 and is mixed with the particles PW supplied from the inlet 7*a*. The remaining part of the air A passes through the passage 6*b* and joins with the mixture at the location before the linkage pins 10 to form the solid-gas two-phase flow K containing the particles PW. While passing through the rotating linkage pins 10, the solid-gas two-phase flow K is subjected to preliminary grinding to be ground by their impact and granulated to a desired particle size. The preliminarily-ground solid-gas two-phase flow K is then introduced into the grinding chamber 2. At this stage, for example, the flow rate is 31 m/s and the flow volume is 25 $m^3$/min.

The solid-gas two-phase flow K goes upward with being circled in the space between the outer peripheral surface of the rotary member 4 and the inner peripheral surface 9*a*, so as to be fully ground or pulverized. The solid-gas two-phase flow K moves in the direction M (FIG. 3) with being circled in the circling direction R (FIG. 2) by the rotation energy of the rotating body 5 that is rotated and driven by the motor 14. At this stage, for example, the flow rate is 28 m/s and the flow volume is 25 $m^3$/min. Reduction of the flow rate to be lower than the supply rate is attributed to energy loss by the impact and the resistance. The corrugated shape of the inner peripheral surface 9*a*, however, has the effect of reducing the energy loss relative to the grinding capacity. The solid-gas two-phase flow K collides against the corrugated inner peripheral surface 9*a* during circling and moving. While the particles contained in the solid-gas two-phase flow K collide with one another, the particles are transported in the direction M and reach the upper portion of the grinding chamber 2 to be discharged on the air flow as fine particles (product) from the outlet 8.

The heavier portion or the larger-size portion (further grinding is allowable) of the particles, on the other hand, loses the speed to go downward and is transported outward on the gas flow (pressure difference) from the center to the outward produced by the centrifugal force of the rotation as shown by the arrows K. This portion of the particles collides against the rotating support plates 43*a*, the circular plates 43*b* and 43*c* and the fixed inner peripheral surface 9*a* to be further ground or pulverized and moves upward.

The waveform of the inner peripheral surface 9*a* has the wave crests and the wave troughs arranged alternately along the circumferential direction, so as to alternately form wider passages and narrower passages between the blade-like rotary member 4 and the inner peripheral surface 9*a*. The solid-gas two-phase flow K is pressed outward by the centrifugal force of the rotation of the rotary member 4 and is repeatedly compressed and expanded at very high speed on the inner peripheral surface 9*a*. Such turbulent motion of the particles PW efficiently grinds or pulverizes the particles PW. The particles PW collide with one another while colliding against the support plates 43*a* for the rotary member 4, the circular plates 43*b* and 43*c*, the linkage pins 10 and the inner peripheral surface 9*a*, so as to be efficiently ground or pulverized. The inner peripheral surface is preferably formed in a curved shape but may be formed in a jagged shape of straight lines.

The pitch of the waveform of the inner peripheral surface 9*a* is set to be greater than the amplitude. This reduces the resistance of the solid-gas two-phase flow and prevents the solid-gas two-phase flow from failing to go over the wave crests and from being accumulated in the wave troughs, thus enhancing the circling effect of the solid-gas two-phase flow.

The inner peripheral surface 9*a* formed as a flat plane produces the homogeneous flow and causes the particles to be ground or pulverized by the linkage pins 10. There is accordingly the possibility that the particles are not sufficiently ground or pulverized. One possible method may machine-form fine grooves on the inner peripheral surface of the frame member 9. Such grooves, however, have the groove width smaller than the pitch of the waveform and are thus likely to be clogged with powder. The mill 1 having the corrugated inner peripheral surface 9*a*, on the other hand, is easily cleanable and has the corrugated curved surface along the flow direction of the solid-gas two-phase flow. This effectively prevents powder clog.

The door 15 receives the upward lifting force by the action of the spring 15*b* and rotates about the hinge 15*a* with moving horizontally to be opened. Without the spring 15*b*, the door 15 is not readily operable. With the spring 15*b*, however, the operation of the door 15 is easy and safe.

As described above, the mill 1 according to this embodiment adopts the frame member 9 having the corrugated inner peripheral surface 9*a* and thereby enhances the throughput per energy cost, compared with the conventional jet mill. The mill 1 of the embodiment does not require an air jet nozzle or a collision plate, which are included in the conventional structure, and can thus be downsized.

The detailed mechanism of the advantageous effects described above is not elucidated, but the inventors have the following presumption. The corrugated shape of the inner peripheral surface 9*a* of the frame member 9 changes the angle of the inner peripheral surface 9*a* relative to the circling direction R of the solid-gas two-phase flow K containing the particles. This causes the solid-gas two-phase flow K to be repeatedly compressed and expanded and have significant changes in cross section. The inner peripheral surface 9*a* generates the periodic turbulent flow and reflects the solid-gas two-phase flow K at random. The particles in the solid-gas two-phase flow K are ground or pulverized by collision against the frame member 9, while colliding with one another to be further ground. This reduces the particles size of the solid-gas two-phase flow K and accelerates grinding. The frame member 9 is made of a non-porous solid, such as metal, that does not allow transmission of the solid-gas two-phase flow K. This ensures the diffused reflection of the particles from the inner peripheral surface 9*a* and thereby enhances the grinding efficiency per energy cost.

The inner peripheral surface 9*a* has the wave crests and the wave troughs formed on its whole circumference, but may be partly formed to include a non-corrugated surface, such as flat surface or an inclined surface.

The linkage pins 10 provided as the preliminary grinder are used to preliminarily grind the particles. This reduces the grinding load.

A mill according to a second embodiment of the invention is a transverse mill that has the horizontally-arranged rotating shaft 3 and does not use a spring to lift up the door 15, but otherwise has the similar or common configuration to that of the mill 1 according to the first embodiment. The description and the illustration of the first embodiment are thus applicable to the mill according to the second embodiment of the invention. The like components are expressed by the like numerals in the 100s. The advantageous effects of the second embodiment are similar to those of the first embodiment, except that the force of gravity is applied to the solid-gas two-phase flow K in a different direction.

A mill 101 according to a third embodiment of the invention has the solid-gas two-phase flow K formed differently from the first embodiment and has the horizontally-arranged rotating shaft like the second embodiment. As shown in FIGS. 5 to 10, the mill 101 includes a grinding chamber 102, a rotating shaft 103 located in the grinding chamber 102, a rotating body 105 structured to have a rotary member 104 fixed to the rotating shaft 103, a casing 106 provided to form an outer shell of the grinding chamber 102, an inlet 107 arranged to supply a solid-gas two-phase flow K containing particles and a gas to the grinding chamber 102, and an outlet 108 arranged to discharge a solid-gas two-phase flow K' from the grinding chamber 102. A cylindrical frame member 109 having a corrugated inner peripheral surface 109*a* is located in the casing 106. The solid-gas two-phase flow K supplied via the inlet 107 into the grinding chamber 102 is circled in the grinding chamber 102, while being accelerated by the rotating body 105. The circling solid-gas two-phase flow K collides against the inner peripheral surface 109*a*, so that the particles are ground or pulverized. The following describes the respective components more specifically with reference to the drawings.

Figure 5:
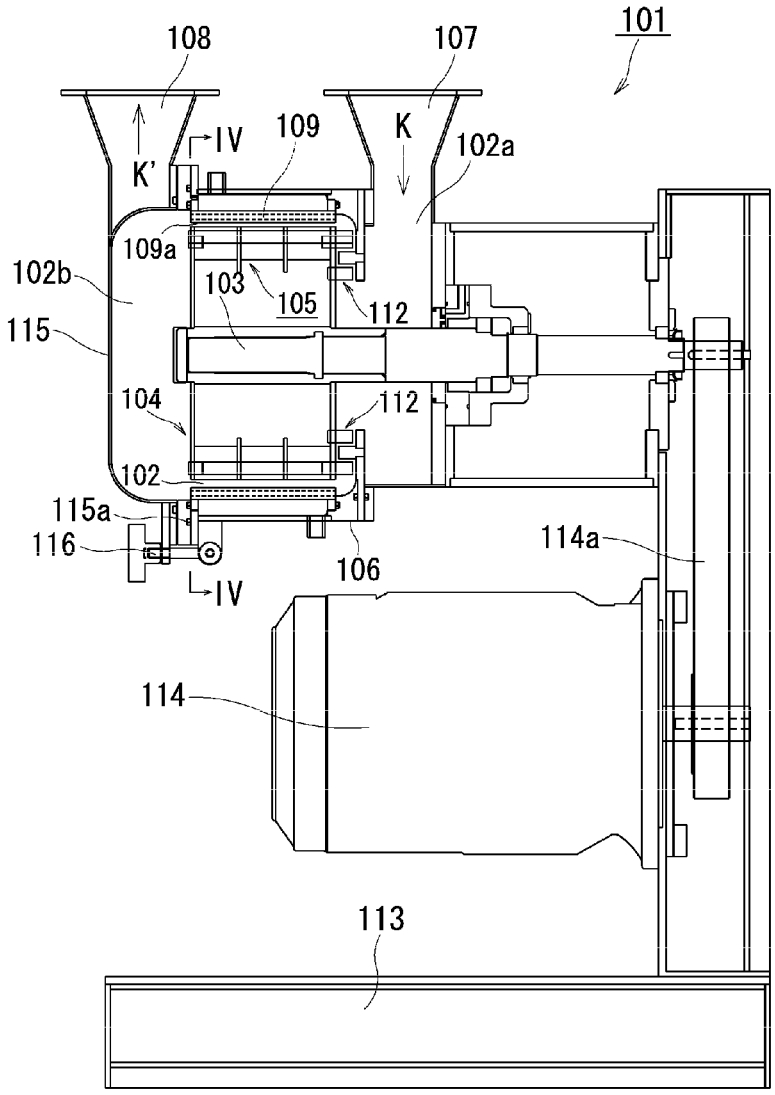
FIG. 5 is a cross sectional view illustrating inside of a mill according to a third embodiment of the invention.
Figure 6:
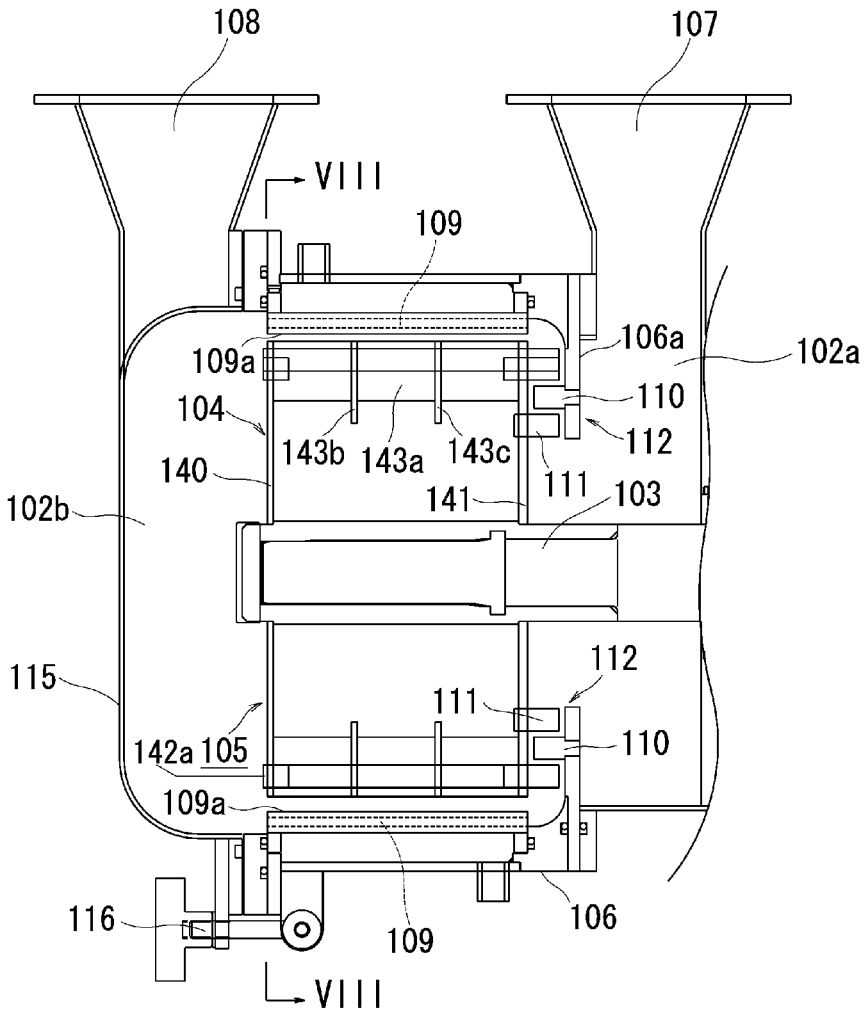
FIG. 6 is an enlarged view illustrating the main part of FIG. 5.
Figure 7:
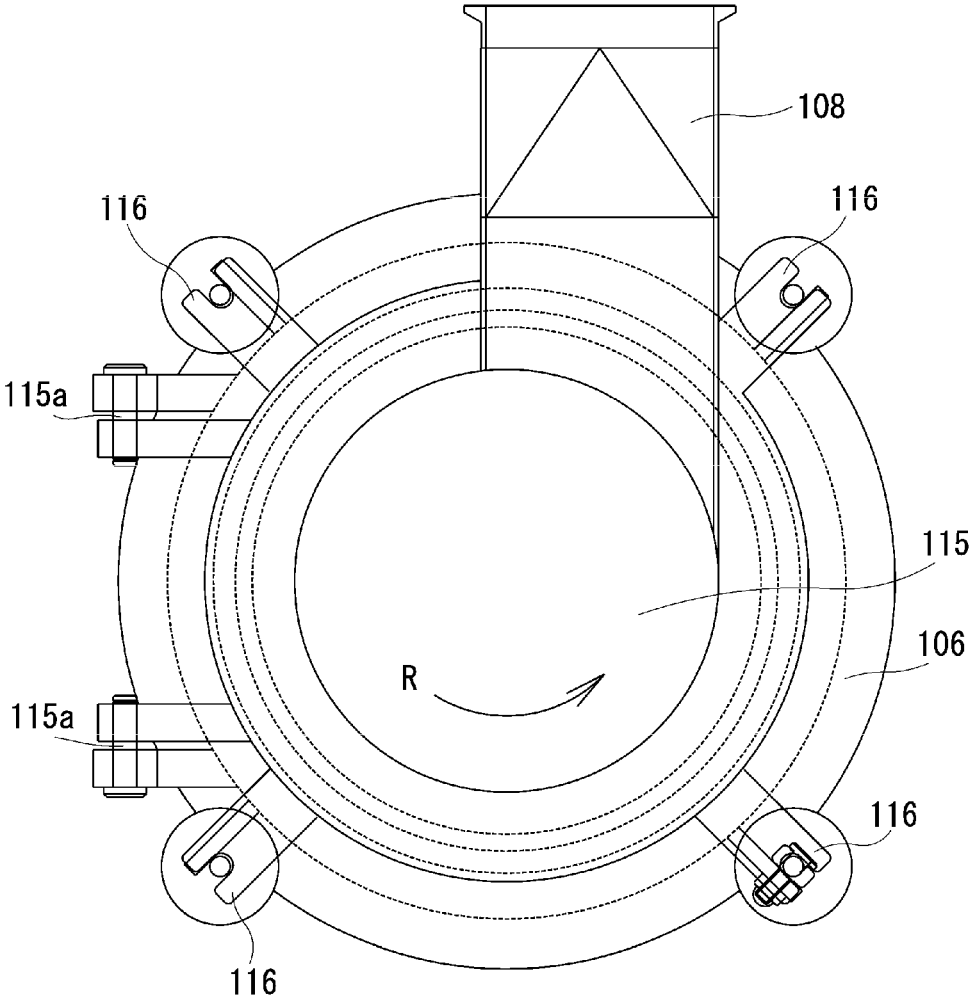
FIG. 7 is a left side view illustrating the main part of the mill.

As shown in FIGS. 5 and 6, the grinding chamber 102 communicates with a feed port 102*a* on the upstream side (right side in FIGS. 5 and 6) and with a discharge port 102*b* on the downstream side (left side in FIGS. 5 and 6). The feed port 102*a* also communicates with the inlet 107, and the discharge port 102*b* also communication with the outlet 108.

As shown in FIGS. 5 and 6, the rotating shaft 103 is arranged horizontally.

Figure 8:
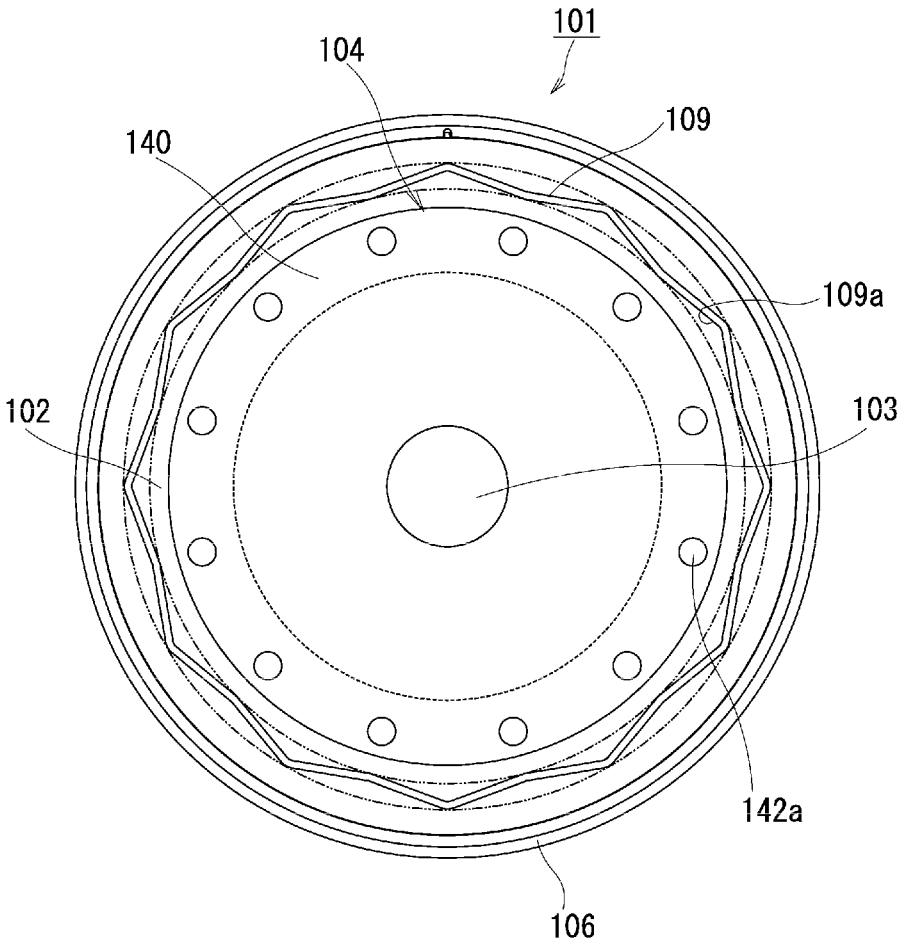
FIG. 8 is a cross sectional view taken on a line VIII-VIII in FIGS. 5 and 6.

As shown in FIGS. 5 and 6, the rotary member 104 includes a downstream circular disc 140 that is arranged perpendicular to the rotating shaft 103 and is linked on the downstream side, an upstream circular disc 141 that is arranged perpendicular to the rotating shaft 103 and is linked on the upstream side, a support plate 143*a* arranged parallel to the rotating shaft 103 to link the downstream circular disc 140 with the upstream circular disc 141, circular plates 143*b* and 143*c* linked with the support plate 143*a* for the purpose of reinforcement, and an interior space 144 defined by the downstream circular disc 140, the upstream circular disc 141, the support plate 143*a* and the circular plates 143*b* and 143*c*. A downstream end and an upstream end of the support plate 143*a* are respectively fixed to the downstream circular disc 140 and the upstream circular disc 141 by means of fixation pins 142*a* (FIG. 8). The interior space 144 forms part of the grinding chamber. Although the rotary member 104 is designed to allow the solid-gas two-phase flow K to enter the rotary member 104, a cylindrical partition member may be provided in an inner area of the support plate 143*a* to prevent the particles to enter the rotary member 104.

The rotating body 105 includes the rotating shaft 103 and the rotary member 104. When the mill 101 receives the solid-gas two-phase flow K, the rotating body 105 circles the solid-gas two-phase flow K, so that the particles collide against the inner peripheral surface 109*a* of the frame member 109 to be ground or pulverized. The solid-gas two-phase flow K' containing the ground or pulverized particles is then discharged.

The suction pressure of a suction blower (not shown) and the rotating body 105 rotating at high speed generate the sucking flow via the inlet 107 into the grinding chamber 102.

The solid-gas two-phase flow K containing the particles PW is accordingly supplied via the inlet 107 into the grinding chamber 102.

As shown in FIGS. 5 and 6, an annular member 106*a* protruded circularly is located on the left side of the feed port 102*a* of the casing 106. This annular member 106*a* is arranged parallel to the upstream circular disc 141, such that its inner left-side area faces a right-side area of the upstream circular disc 141.

The inlet 107 is arranged to receive the solid-gas two-phase flow K pneumatically transported through a piping (not shown) and introduce the received solid-gas two-phase flow K into the feed port 102*a*. The mill 101 according to the embodiment does not require an air jet nozzle or a collision plate, which are included in the conventional structure.

A suction blower (not shown) is connected with the outlet 108 to suck the air, so that the solid-gas two-phase flow K is supplied via the inlet 107.

As shown in FIGS. 5, 6 and 8, the frame member 109 having the inner peripheral surface 109*a* as the characteristic structure of the embodiment is arranged coaxially with the rotating shaft 103 and is located adjacent to the inner peripheral surface of the casing 106 across a gap. The description of the frame work 9 of the first embodiment is also applicable to this embodiment. Although there is a gap between the frame member 109 and the casing 106 as shown in the cross sectional diagram of FIG. 8, a spacer is placed between the casing 106 and the frame member 109 to prevent the particles from entering the gap.

Figure 9:
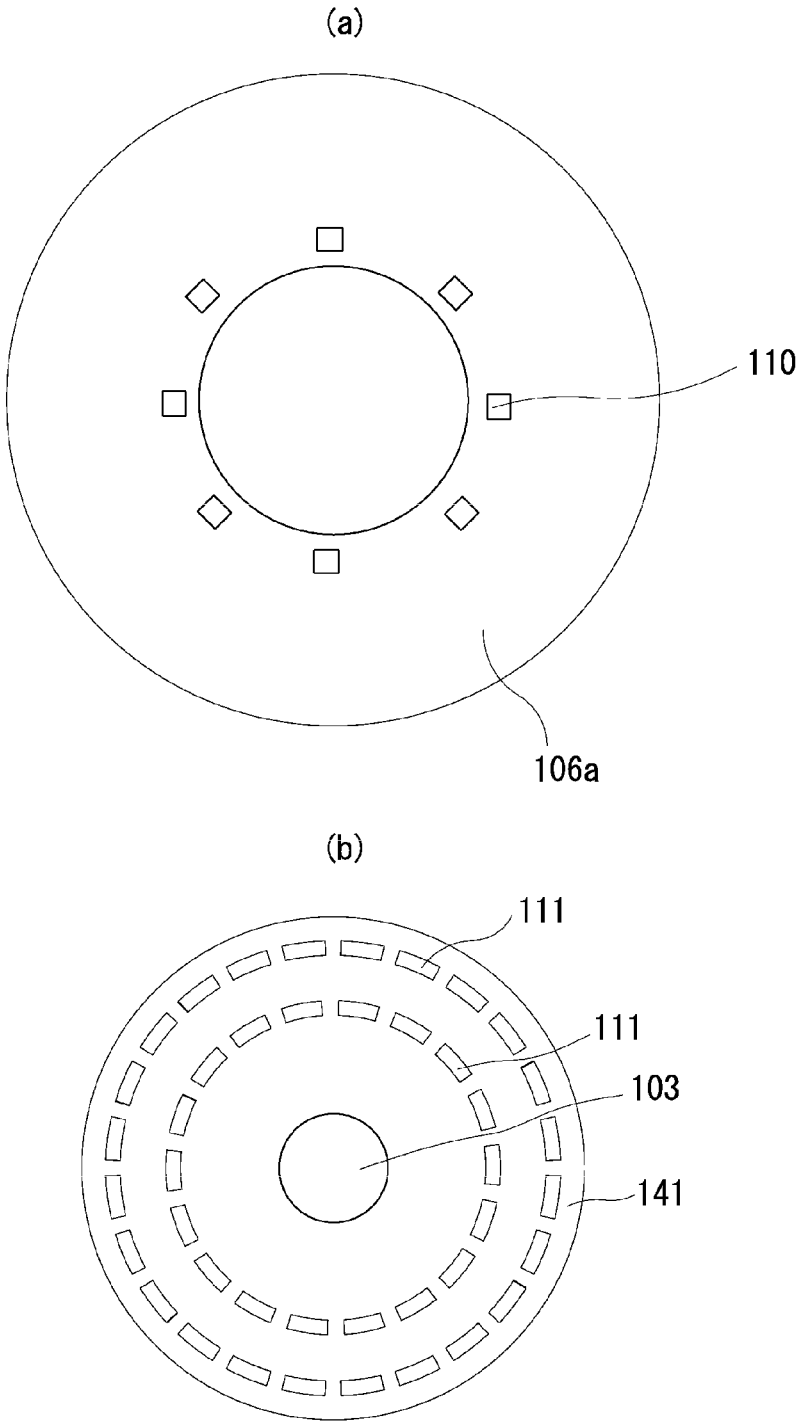
FIG. 9*a* is a left side view illustrating an annular member and shock pins included in a preliminary grinder.
FIG. 9*b* is a right side view illustrating an upstream circular disc and shock pins included in the preliminary grinder.

As shown in FIGS. 5, 6 and 9, a preliminary grinder 112 is provided to have first pins 110 circularly arranged and protruded from the annular member 106*a* in the direction parallel to the rotating shaft 103 and second pins 111 circularly arranged and protruded in the direction parallel to the rotating shaft 103 to engage with the first pins 110 with some clearance on the right side of the upstream circular disc 141. The second pins 111 are rotated relative to the stationary first pins 110, so as to grind the particles by the impact. Locating the preliminary grinder 112 at the inlet of the grinding chamber 102 downsizes the mill 101 and enhances the grinding effect in the grinding chamber 102.

As shown in FIG. 5, the rotating shaft 103 is driven by a motor 114 and a drive belt 114*a* fastened to a mount 113.

The following describes the operations of the mill 101. The solid-gas two-phase flow K containing the particles to be ground or pulverized is supplied via the inlet 107 and is introduced into the feed port 102*a*. The solid-gas two-phase flow K supplied to the feed port 102*a* is then introduced into the preliminary grinder 112. The solid-gas two-phase flow K entering the preliminary grinder 112 runs between the first pins 110 and the second pins 111 to be ground by the impact of the stationary first pins 110 and the rotating second pins 111 and to be granulated to a desired particle size and is then introduced into the grinding chamber 102. The solid-gas two-phase flow K moves leftward in FIGS. 5 and 6, while being circled in the circling direction R (FIG. 7) by the rotation energy of the rotating body 105 driven and rotated by the motor 114. The support plate 143*a* serves as the rotating blade. Reduction of the flow rate to be lower than the supply rate is attributed to energy loss by the impact and the resistance. The corrugated shape of the inner peripheral surface 109*a*, however, has the effect of reducing the energy loss relative to the grinding capacity. The solid-gas two-phase flow K collides against the corrugated inner peripheral surface 109*a* during circling and moving. While the particles contained in the solid-gas two-phase flow K collide with one another, the particles move leftward in FIGS. 5 and 6 to arrive at the feed port 102*b* and are discharged as fine particles (product) from the outlet 108.

Figure 10:
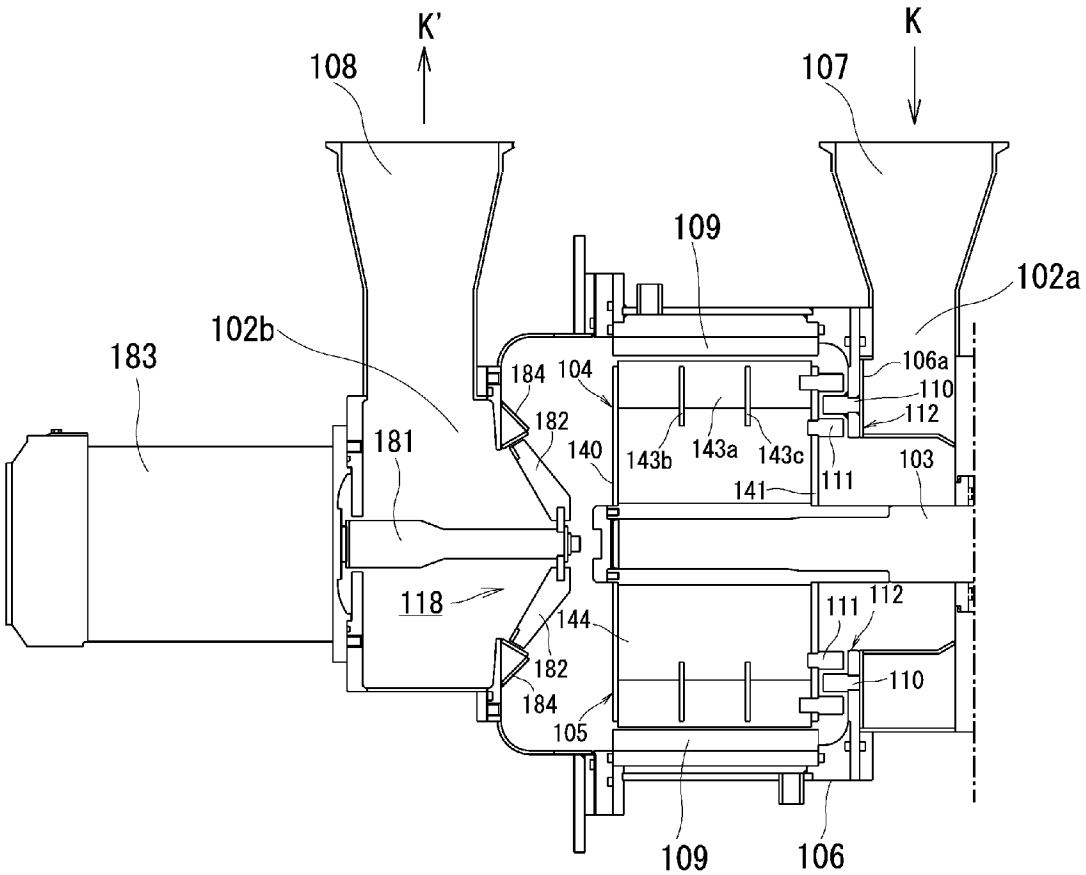
FIG. 10 is a vertical sectional view illustrating inside of a modified structure of the mill.

According to one modification shown in FIG. 10, the volume of the discharge port 108 is expanded, and a classifier 118 is provided in the expanded space. The classifier 118 includes a rotating shaft 181, a plurality of blade members 182 arranged radially about the rotating shaft, a motor 183 provided to drive the rotating shaft 181, and support members 184 arranged to support the respective ends of the blade members 182 in a freely rotatable manner. With rotation of the blade members 182, the particles of the size greater than the desired particle size are returned to the grinding chamber 102. The particles of the size equal to or less than the desired particle size are discharged from the discharge port 102*b*.

The force of gravity is applied parallel to the rotating direction of the particles contained in the solid-gas two-phase flow K. The particles may be accumulated in a partial area, for example, on the bottom, of the simple cylindrical structure. According to the embodiment, however, the corrugated inner peripheral surface 109*a* has the effect of lifting up the particles by the circular plates 143*b* and 143*c*, compared with the simple cylindrical surface. This diffuses the particles upward and prevents accumulation of the particles.

The invention is not limited to the above embodiments but may be altered, modified, substituted, replaced or omitted in various ways without departing from the scope of the invention. Such modifications and alterations are also included in the scope of the invention. For example, the diameter, the pitch, the amplitude and the height of the inner peripheral surface 109*a* of the frame member may be changed according to the requirements. The rotating shaft 103 is arranged horizontally or vertically according to the above embodiments but may be inclined in some situations.

INDUSTRIAL APPLICABILITY

The mill of the invention is applicable to grind or pulverize particles of, for example, foods, chemicals, pharmaceutical products and toners of copying machines or more specifically flours, buckwheat flours, soy beans, red beans, coffee beans, corns, dried noodles, rice snacks and noodle offcuts.

REFERENCE SIGNS LIST

1: Mill
2: Grinding chamber
3: Rotating shaft
4: Rotary member
5: Rotating body
6: Casing
PW: Particles
7*a*: Inlet
7*b*: Inlet
7*c*: Inlet
K': Solid-gas two-phase flow
8: Outlet
9*a*: Inner peripheral surface
9: Frame member
K: Solid-gas two-phase flow
40: Downstream circular disc
41: Upstream circular disc
10: Linkage pin
43*a*: Support plate
43*b*, 43*c*: Circular plates
44: Interior space
45: Partition plate

6*a*: Annular member
6*b*: Passage
6*c*: Support member
6*d*: Circular plate member
13: Mount
14: Motor
15: Door
15*a*: Hinge
15*b*: Spring
16: Locking device
17: Piping
18: Power distribution unit
101: Mill
102: Grinding chamber
102*a*: Feed port
102*b*: Discharge port
103: Rotating shaft
104: Rotary member
140: Downstream circular disc
141: Upstream circular disc
143*a*: Support plate
142*a*: Fixation pin
143*b*, 143*c*: Circular plates
144: Interior space
105: Rotating body
106: Casing
106*a*: Annular member
K, K': Solid-gas two-phase flow
107: Inlet
108: Outlet
109*a*: Inner peripheral surface
109: Frame member
110, 111: Shock pins
112: Preliminary grinder
114: Motor
114*a*: Drive belt
115: Cover
115*a*: Hinge
116: Locking device
118: Classifier
181: Rotating shaft
182: Blade member
183: Motor
184: Support member

The invention claimed is:

1. A mill, comprising:
a grinding chamber;
a rotating shaft located in the grinding chamber, the rotating shaft comprising a central axis;
a rotating body structured to have a disk-shaped rotary member fixed to the rotating shaft;
a casing provided to form an outer shell of the grinding chamber; and
a cylindrical frame member having an inner peripheral surface formed in a corrugated shape along a circumferential direction of the inner peripheral surface;
wherein:
the cylindrical frame member is arranged coaxially with the rotating shaft in the casing;
the corrugated shape comprises a plurality of corrugation crests and a plurality of corrugation troughs;
a pitch of the corrugated shape is greater than an amplitude of the corrugated shape, wherein the pitch is an interval between two adjacent corrugation crests, and the amplitude is a difference between a distance from the corrugation crests to the central axis and a distance from the corrugation troughs to the central axis;
the disk-shaped rotary member has a circular member; and
when in use, a solid-gas two-phase flow being a flow of a mixture of particles and a gas is introduced through a gap between the casing and the rotating body into the grinding chamber, then is circled in the grinding chamber while being accelerated by the rotating body, and collides against the inner peripheral surface and the circular member to grind or pulverize the particles.

2. The mill of claim 1, further comprising a preliminary grinder located at an inlet of the gap, the preliminary grinder comprising a plurality of pins, wherein:
the plurality of pins is disposed on the disk-shaped rotary member and is parallel to the rotating shaft; and
when in use, the rotating shaft rotates to drive the disk-shaped rotary member and the plurality of pins, the solid-gas two-phase flow passes through the plurality of pins and collides with the plurality of pins to be granulated into a desired particle size.

3. The mill of claim 1, wherein the circular member includes a plurality of support plates arranged circularly and protruded in a radial direction, and circular plates linked by the support plates, wherein the solid-gas two-phase flow is circled by rotation force of the circular plates and is collided against the inner peripheral surface in the circumferential direction.

4. The mill of claim 1, further comprising a preliminary grinder located at an inlet of the grinding chamber and an annular member, the preliminary grinder comprising a first plurality of pins and a second plurality of pins, wherein:
the annular member is perpendicular to the rotating shaft;
the first plurality of pins is disposed on the annular member and is parallel to the rotating shaft;
the second plurality of pins is disposed on the disk-shaped rotary member and is parallel to the rotating shaft; and
when in use, the rotating shaft rotates to drive the disk-shaped rotary member and the second plurality of pins, the solid-gas two-phase flow passes between the first plurality of pins and the second plurality of pins and collides with the first plurality of pins and the second plurality of pins to be granulated into a desired particle size.

5. The mill of claim 1, wherein:
the pitch is from 50 to 200 mm;
the amplitude is from 5 to 20 mm; and
a ratio of the pitch to the amplitude is from 2.5 to 40.

6. The mill of claim 5, wherein:
the pitch is from 50 to 200 mm;
the amplitude is from 5 to 20 mm; and
a ratio of the pitch to the amplitude is from 2.5 to 40.

7. A mill, comprising:
a grinding chamber, the grinding chamber comprising a casing and a cylindrical frame member, the cylindrical frame member comprising an inner peripheral surface, the inner peripheral surface being in a corrugated shape along a circumferential direction of the inner peripheral surface, the corrugated shape comprising a plurality of corrugation crests and a plurality of corrugation troughs, and the corrugated shape having a pitch and an amplitude;
a rotating shaft, the rotating shaft comprising a central axis;
a rotating body, the rotating body comprising a rotary member, the rotary member comprising a circular member;
a particle inlet;
an air inlet; and
a pipeline;
wherein:
the rotating shaft is located in the grinding chamber;

the cylindrical frame member is disposed inside the casing and is arranged coaxially with the rotating shaft;

the rotary member is disk-shaped and is disposed on the rotating shaft;

the circular member is disposed on the rotary member;

the pitch is an interval between two adjacent ones of the plurality of corrugation crests;

the amplitude is a difference between a distance from the plurality of corrugation crests to the central axis and a distance from the plurality of corrugation troughs to the central axis;

the pitch is larger than the amplitude, the particle inlet and the air inlet are connected to the pipeline;

the pipeline is connected to the grinding chamber.

* * * * *